United States Patent [19]

Kataoka

[11] Patent Number: 4,494,044

[45] Date of Patent: Jan. 15, 1985

[54] COMPUTER TYPE ELECTRONIC FLASH DEVICE

[75] Inventor: Hiroyuki Kataoka, Saitama, Japan

[73] Assignee: Canon Kabushiki Kaisha, Tokyo, Japan

[21] Appl. No.: 386,231

[22] Filed: Jun. 8, 1982

[30] Foreign Application Priority Data

Jun. 18, 1981 [JP] Japan ..... 56-94443

[51] Int. Cl.[3] ..... H05B 37/02

[52] U.S. Cl. ..... 315/151; 315/241 P

[58] Field of Search ..... 315/151, 159, 241 P; 354/33, 145, 419

[56] References Cited

U.S. PATENT DOCUMENTS 3,714,443 1/1973 Ogawa ..... 315/151 X 4,379,983 4/1983 Takematsu ..... 315/151

*Primary Examiner*—David K. Moore

*Attorney, Agent, or Firm*—Toren, McGeady and Stanger

[57] ABSTRACT

The disclosed computer type electronic flash device has a light measuring circuit which produces a flash terminating signal upon receipt of light reflected from an object to be photographed. Connected to this light measuring circuit is a control circuit which renders the former inoperative after the lapse of time required by a flash tube for terminating emission of a flash light. This arrangement precludes a commutating circuit from being rendered conductive again after termination of flash by the flash tube.

1 Claim, 3 Drawing Figures

COMPUTER TYPE ELECTRONIC FLASH DEVICE

BACKGROUND OF THE INVENTION

This invention relates to a computer type electronic flash device and more particularly to a computer type electronic flash device having a light measuring circuit which controls the light extinguishing time of a flash tube by receiving a reflection light coming from an object to be photographed and reflecting light flashed at the object by the flash tube.

Generally, a light measuring circuit of this type is arranged to normally remain in an inoperative state and to operate concurrently with commencement of flashing by the flash tube. The light measuring circuit produces a flash terminating signal. This signal renders a commutating circuit conductive to turn off a thyristor which is arranged in series with the flash tube and thus forces the flash tube to terminate the flash during the process of its flashing action. Following that, the commutating circuit becomes inoperative and then again becomes operative. However, in the conventional flash devices, the flash terminating signal is continuously produced until the commutating circuit again becomes operative. With the signal continuously produced in this manner, a capacitor which is arranged to supply a light energy to the flash device is short-circuited by the commutating circuit and thus remains uncharged. In addition to such a disadvantage, a DC-DC converter which is disposed in a route connecting a power source battery to the capacitor becomes overloaded. This tends to have heat produced by a circuit resistance.

SUMMARY OF THE INVENTION

It is a general object of the present invention to provide a computer type electronic flash device which obviates the above-stated shortcomings of conventional flash devices of this type.

The above and further objects, features and advantages of the invention will become apparent from the following detailed description of preferred embodiments thereof taken in connection with the accompanying drawings.

DETAILED DESCRIPTION OF PREFERRED EMBODIMENTS

Figure 1:
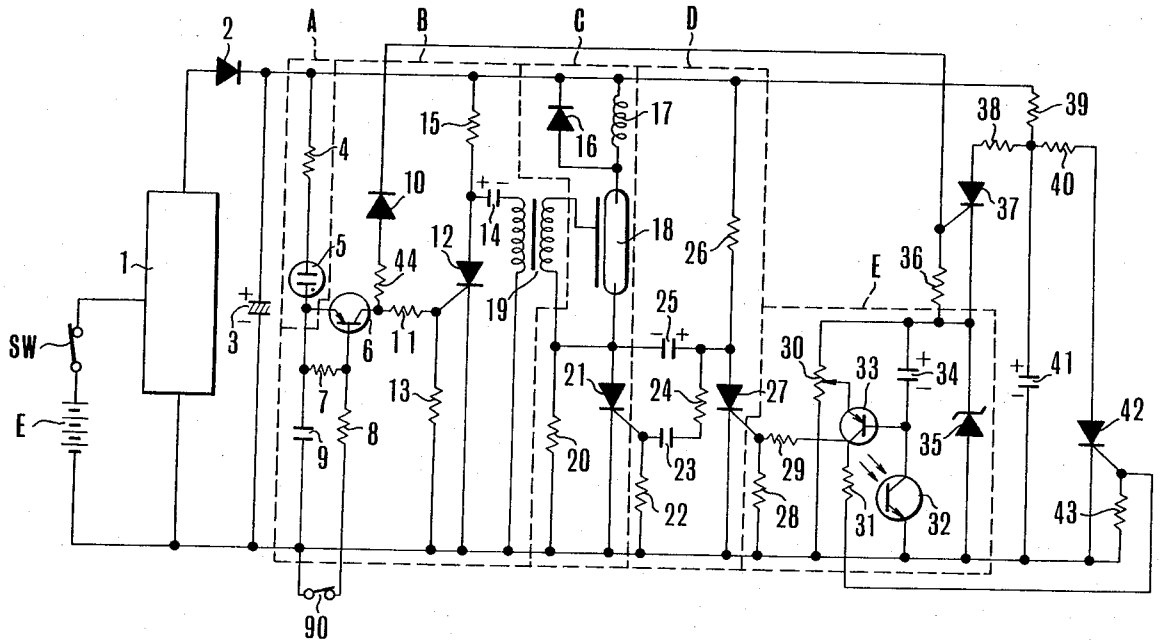
FIG. 1 is a circuit diagram showing a first embodiment of the invention.

The electrical circuit diagram of the first embodiment of the present invention as shown in FIG. 1 includes a power source E; a power source switch SW; an oscillation circuit 1 of a DC-DC converter; a rectifying diode 2; a main capacitor 3; a display circuit A consisting of a resistor 4 and a neon tube 5; a trigger circuit B consisting of resistors 7, 8, 11, 13 and 15, capacitors 9 and 14, a diode 10, a thyristor 12 and a trigger transformer 19; a flashing circuit C consisting of a diode 16, a coil 17, a flash tube 18, a resistor 20 and a thyristor 21; a commutating circuit D consisting of resistors 22, 24 and 26, a capacitors 23 and 25 and a thyristor 27; a light measuring circuit E consisting of resistors 28–31, a photo diode 32, a transistor 33, a capacitor 34 and a Zener diode 35; a resistor 39 for charging a capacitor 41; a thyristor 37 arranged to become conductive by receiving at the gate thereof a signal from a series arrangement of a resistor 44 and the diode 10; a discharge resistor 38 which is arranged to have the electric charge of the capacitor 41 discharged to the Zener diode 35 through the thyristor 37; a resistor 36 connected to the gate cathode of the thyristor 37; a resistor and a thyristor 40 and 42 which forms a charge circuit for the capacitor 41; a resistor 43 connected to the gate cathode of the thyristor 42, above-stated resistor 31 being connected between the collector of the transistor 33 and the gate of the thyristor 42; and a synchronizing contact 90 disposed between a connection line on the negative electrode side and the base of the transistor 6.

Figure 3:
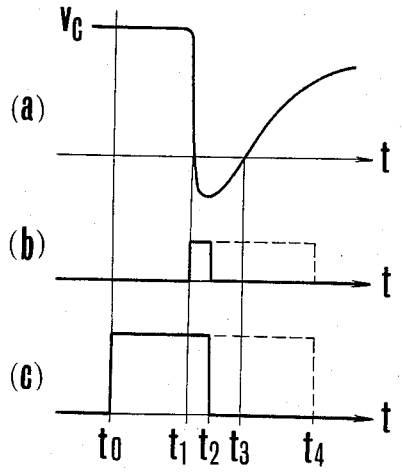
FIG. 3 is a signal wave form chart illustrating the operation of the first embodiment.

The first embodiment as described above, operates in the following manner: When the power source switch SW is closed, the capacitors included in the circuit arrangement are respectively charged to the polarity as indicated in the drawing. Closing of the synchronizing contact 90 in this condition renders the transistor 6 conductive in turn to render the trigger circuit B operative. The trigger circuit causes the flash tube 18 to begin its a flash action. Concurrently with the start of flashing, a signal is supplied to the gate of the thyristor 37 to render the thyristor 37 conductive through the resistor 44 and the diode 10. With the thyristor thus rendered conductive, the electric charge of the capacitor 41 is supplied to the Zener diode 35 through the resistor 38 and the thyristor 37. This causes the light measuring circuit E to begin to operate (time "to" in FIG. 3(*c*)).

After that, the integrating capacitor 34 is charged with the photo-electric current of the photo diode 32 which receives light reflected from the object to be photographed. When the charge voltage of the capacitor 34 reaches a given level, the transistor 33 becomes conductive and supplies the flash terminating signal (FIG. 3(*b*)) to the gate of the thyristor 27 through the resistor 29 at time "t1" to turn on the thyristor 27. This causes the electric charge Vc of the capacitor 25 (FIG. 3(*a*)) to be impressed on the thyristor 21 in an inversely biasing manner to render the thyristor nonconductive. After that, when the commutation capacitor 25 is charged in a direction reverse to the direction shown in the drawing to render the thyristor 27 also nonconductive, the discharge current from the capacitor 3 to the flash tube 18 is completely cut off. Then the flash of light from the tube 18 comes to an end. Whereas, in the case of the conventional device, the discharge loop consisting of the capacitor 41, the resistor 38, the thyristor 37 and the Zener diode 35 still keeps on working even after this flash termination. Accordingly, a driving voltage is continuously impressed on the light measuring circuit as indicated by a dotted line in FIG. 3(*c*) up to time t4 to keep the light measuring circuit working till the time t4. Therefore, the flash terminating signal of the flash tube is also kept on as indicated by a dotted line in FIG. 3(*b*). This causes the thyristor 27 which is forwardly biased to again become conductive. Then, the capacitor 3 which supplies the flash tube 18 with a light energy is short-circuited by the thyristor 27 of the commutating circuit D and is not charged. This presents a problem. This has been a shortcoming of the conventional device.

To solve this problem, this embodiment is arranged such that a conduction signal (or the flash terminating signal) of the transistor 33 is impressed on the gate of the thyristor 42 through the resistor 31 to render the thyristor conductive and thus to connect the discharge loop of the resistor 40 to the capacitor 41. With the discharge loop connected, the electric charge of the capacitor 41 is rapidly discharged. As a result of this, both ends of the Zener diode which serves as the power source for the light measuring circuit have no voltage impressed therebetween. The light measuring circuit then stops working before the point of time t2 between the points of time t1 and t3 shown in FIG. 3(*c*) during which period, an inverse bias is impressed on the thyristor 21 by the commutating circuit. In other words, the light measuring circuit stops working before the thyristor 27 again becomes forwardly biased. In this instance, the resistance value of the resistor 40 is determined to produce a time constant that is sufficient to have the thyristor 27 rendered conductive for the first time after the generation of the conduction signal, i.e. the flash terminating signal, of the transistor 33 and that precludes the commutating circuit from effecting an erroneous action.

Figure 2:
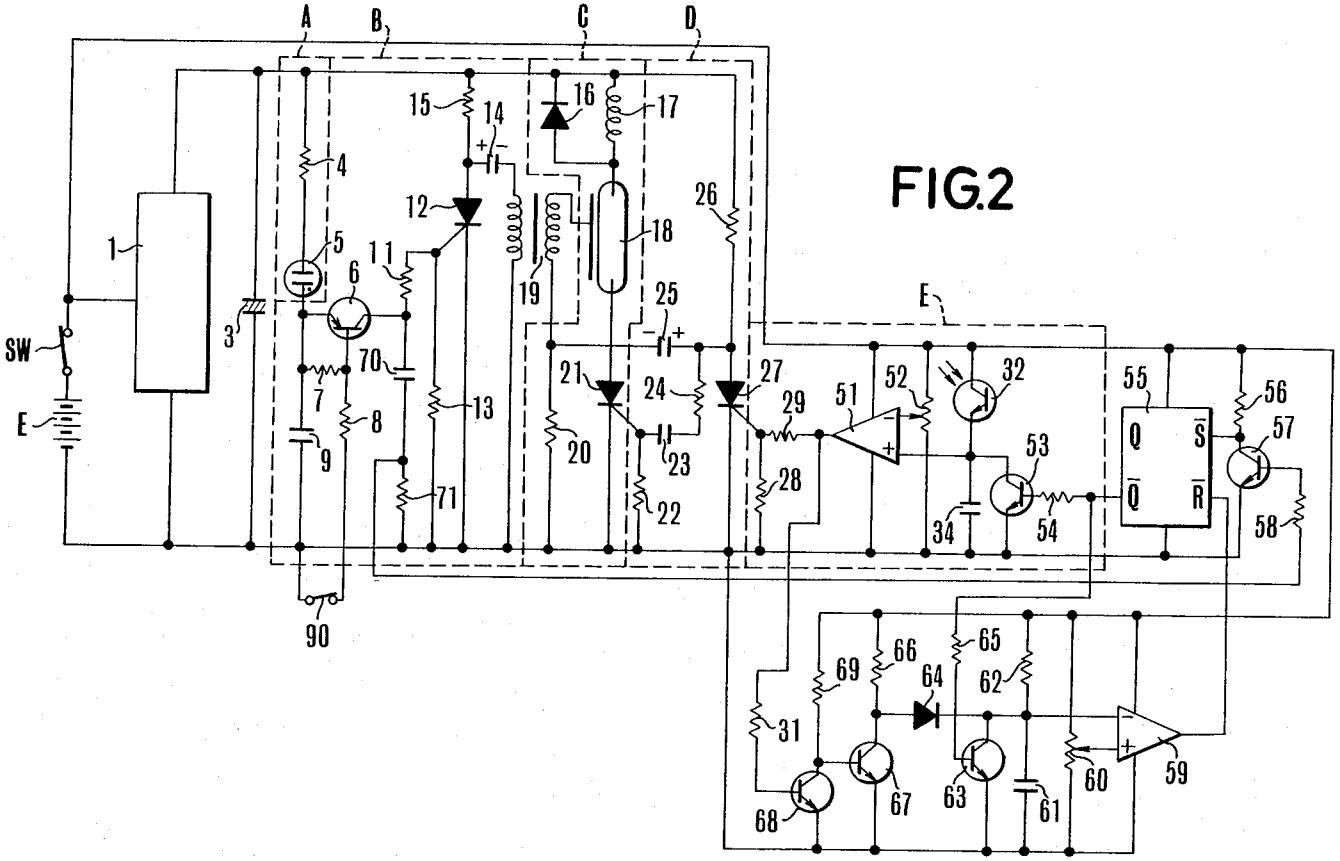
FIG. 2 is a circuit diagram showing a second embodiment of the invention.

A second embodiment of the invention has the circuit arrangement shown in FIG. 2 in which the same parts as those shown in FIG. 1 are indicated with the same reference numerals used in FIG. 1. The second embodiment includes a comparator 51 which is provided for the purpose of detecting the level of the light measuring circuit; a transistor 53 for discharging the electric charge of the integrating capacitor 34; and RS flip-flop; a transistor 68 and a resistor 69 of a circuit forming an inverter; a transistor 67 which is arranged to render a CR time constant circuit 67 consisting of a resistor 66, a capacitor 61 and a diode 64 operative or inoperative; the capacitor 61 and a resistor 62 which form the CR time constant circuit; a comparator 59 which discerns the voltage level of the capacitor 61; and a transistor 63 which short-circuits the capacitor 61 of the above-stated time constant circuit when the $\overline{Q}$ terminal of the RS flip-flop 55 is at a high level.

The operation of the second embodiment is arranged described above will be understood from the following description: The operating processes after closing of the power source switch SW to close the synchronizing contact 90 and before the commencement of flashing by the flash tube 18 are identical to the operation of the first embodiment.

Meanwhile, with the synchronizing contact 90 closed, a signal of a low level is impressed on the $\overline{S}$ terminal of the RS flip-flop 55 through a differentiation circuit formed by the capacitor 70 and the resistor 71, the resistor 58 and the transistor 57. The impression of the low level signal inverts the RS flip-flop 55. The level of the $\overline{Q}$ terminal becomes low to render the transistor 53 nonconductive. This causes the capacitor 34 to begin an integrating action by being charged with the output of the photo diode 32 which has received light reflected from the object to be photographed. Further, the low level output of the $\overline{Q}$ terminal of the RS flip-flop 55 renders the transistor 63 nonconductive through the resistor 65. Therefore, the capacitor 61 begins to charge through the resistor 62. Then, since the level of the output of the comparator 59 is high and that of the output of the comparator 51 is low at that time, the transistor 67 becomes conductive through the resistor 31. Therefore, the resistor 66 and the diode 64 do not form another charging loop for charging the capacitor 61. Accordingly, the capacitor 61 is charged at the time determined by the resistor 62.

When the electric charge of the integrating capacitor 34 reaches a prescribed value to change the output of the comparator 51 to a high level, the thyristor 27 turns on. The electric charge of the capacitor 25 then turns off the thyristor 21 to bring the flashing action of the flash tube 18 to a stop. Then, concurrently with this, the transistor 67 is rendered nonconductive through the resistor 31 and the transistor 68. The capacitor 61 is then rapidly charged through the resistor 66 and the diode 64. With the electric charge of the capacitor 61 having reached a prescribed value, the comparator 59 is inverted and the level of the output thereof becomes low to apply a reset signal to the $\overline{R}$ terminal of the RS flip-flop 55. The level of the $\overline{Q}$ terminal of the flip-flop 55 becomes high to render the transistor 53 conductive to bring the action of the light measuring circuit to a stop.

Since the high level output of the $\overline{Q}$ terminal renders the transistor 63 conductive, the electric charge of the capacitor 61 is discharged to bring the capacitor 61 back to its original state. When the level of the output of the comparator 51 does not become high, the capacitor 61 cannot be rapidly charged and, therefore, the action of the light measuring circuit comes to a stop after a lapse of time determined by the capacitor 61.

In accordance with the invention as described above, after the flash terminating signal is produced by the flash circuit, the flash tube is stopped from flashing by rendering the light measuring circuit inoperative after the lapse of time required for stopping the flash tube from flashing. Therefore, after the flash terminating signal is produced, the commutating circuit, arranged to turn off the thyristor disposed in series with the flash tube, is never left in a conductive state. As a result of this arrangement, the electric charge energy of the charging and discharging capacitor which is arranged to supply the flash tube with flash energy is never wasted. The invented arrangement also obviates the inconvenience of having the capacitor uncharged. Therefore, a light adjusting type flash device with a high degree of reliability can be obtained in accordance with the invention.

What is claimed is:

1. A computer type electronic flash device comprising:

(a) flash illuminating means for producing light energy;

(b) light measuring means for receiving the light of the flash illuminating means as reflected by an object to be photographed, and for producing a flash terminating signal;

(c) first control means operative in response to the flash terminating signal to render said flash illuminating means inoperative;

(d) a power source having a charged capacitor, the capacitor supplying electric power to the light measuring means concurrently with the commencement of the operation of said flash illuminating means; and (e) second control means for rendering said power source inoperative in response to said flash terminating signal, the second control means having a resistor connected in parallel to the capacitor in response to said flash terminating signal.

* * * * *